US008726441B1

(12) United States Patent
Colasanti et al.

(10) Patent No.: US 8,726,441 B1
(45) Date of Patent: May 20, 2014

(54) FLOOR SWEEPER WITH SPLIT BRUSH ASSEMBLY

(75) Inventors: John Albert Colasanti, Coopersville, MI (US); Charles A. Reed, Jr., Rockford, MI (US); Mitchell Auerbach, Nunica, MI (US); Jonathan L. Miner, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 382 days.

(21) Appl. No.: 12/892,352

(22) Filed: Sep. 28, 2010

Related U.S. Application Data

(60) Provisional application No. 61/246,365, filed on Sep. 28, 2009.

(51) Int. Cl.
*A47L 11/32* (2006.01)

(52) U.S. Cl.
USPC ..... 15/41.1; 15/42; 15/46; 15/48

(58) Field of Classification Search
USPC ..... 15/41.1, 42, 46, 48
IPC ..... A47L 11/32
See application file for complete search history.

(56) References Cited

U.S. PATENT DOCUMENTS

| | | | | | |
|---|---|---|---|---|---|
| 21,223 | A | * | 8/1858 | Herrick | |
| RE1,079 | E | * | 11/1860 | Herrick | 15/41.1 |
| RE5,875 | E | * | 5/1874 | Herrick | 15/41.1 |
| 255,823 | A | | 4/1882 | Soper | |
| 500,976 | A | | 7/1893 | Tangenberg | |
| 1,204,718 | A | * | 11/1916 | Vander Putten | 15/388 |
| 2,026,414 | A | * | 12/1935 | Burch | 15/48 |
| 2,057,181 | A | | 10/1936 | Bloom | |
| 2,121,880 | A | * | 6/1938 | Miller | 15/48 |
| 2,406,247 | A | | 8/1946 | Owen | |
| 2,635,269 | A | * | 4/1953 | Smith | 15/41.1 |
| 2,651,803 | A | * | 9/1953 | Browne | 15/373 |
| 2,841,807 | A | * | 7/1958 | Pullen | 15/48 |
| 2,899,225 | A | | 8/1959 | Birr | |
| 2,918,687 | A | * | 12/1959 | Lathrop | 15/41.1 |
| 2,975,450 | A | * | 3/1961 | Williams | 15/48 |
| 3,034,163 | A | | 5/1962 | Stevens et al. | |

(Continued)

FOREIGN PATENT DOCUMENTS

| | | | |
|---|---|---|---|
| CN | 2759371 | Y | 2/2006 |
| CN | 2868167 | Y | 2/2007 |

(Continued)

*Primary Examiner* — Joseph J Hail
*Assistant Examiner* — Marc Carlson
(74) *Attorney, Agent, or Firm* — McGarry Bair PC

(57) ABSTRACT

A floor sweeper for recovering material from a surface to be cleaned comprises a handle assembly pivotably attached to a foot assembly. The foot assembly comprises a housing forming a brush chamber having a bottom opening. The foot assembly comprises a pair of driving gears and a split brush assembly rotatably mounted within the brush chamber and adapted to contact the surface through the opening. The brush assembly comprises two separately-rotatable halves each corresponding to one of the driving gears, with each half comprising a brush core, brush paddles or bristles affixed to an exterior of the brush core, and a brush gear adapted for rotation with the brush core. Each brush gear is driven by a corresponding driving gear to the corresponding brush core as the floor assembly is moved across the surface in order to drive the brushes to cleaning of the surface.

18 Claims, 9 Drawing Sheets

(56) References Cited

U.S. PATENT DOCUMENTS

| | | | | | |
|---|---|---|---|---|---|
| 3,061,857 | A | * | 11/1962 | Garms | 15/44 |
| 3,319,278 | A | | 5/1967 | Frazer | |
| 3,583,818 | A | * | 6/1971 | Smyth et al. | 401/22 |
| 3,587,127 | A | * | 6/1971 | Rosendall | 15/48 |
| 3,646,629 | A | * | 3/1972 | Bienek | 15/48 |
| 3,673,625 | A | * | 7/1972 | Fukuba | 15/42 |
| 3,688,338 | A | * | 9/1972 | Lundvall | 15/364 |
| 3,750,215 | A | | 8/1973 | Liebscher | |
| 3,789,454 | A | * | 2/1974 | Drappeu et al. | 15/41.1 |
| 3,815,167 | A | * | 6/1974 | Leifheit | 15/42 |
| 3,818,532 | A | | 6/1974 | Leifheit et al. | |
| 3,842,459 | A | * | 10/1974 | Tsuruzawa et al. | 15/48 |
| 1,442,587 | A | | 7/1976 | Moulenex | |
| 3,978,539 | A | | 9/1976 | Yonkers | |
| 4,028,765 | A | * | 6/1977 | Liebscher | 15/42 |
| 4,094,032 | A | | 6/1978 | Liebscher et al. | |
| 4,124,913 | A | * | 11/1978 | Rosendall | 15/42 |
| 4,168,561 | A | * | 9/1979 | Rosendall | 15/42 |
| 4,357,727 | A | * | 11/1982 | McDowell | 15/41.1 |
| 4,369,539 | A | * | 1/1983 | Nordeen | 15/52.1 |
| 4,484,371 | A | | 11/1984 | Patzold et al. | |
| 4,646,380 | A | * | 3/1987 | Kobayashi et al. | 15/41.1 |
| 4,701,969 | A | * | 10/1987 | Berfield et al. | 15/79.1 |
| 4,823,422 | A | * | 4/1989 | Yoshimura et al. | 15/41.1 |
| 4,845,797 | A | * | 7/1989 | Kobayashi | 15/41.1 |
| 4,878,261 | A | * | 11/1989 | Rosendall | 15/41.1 |
| 5,148,569 | A | * | 9/1992 | Jailor et al. | 15/41.1 |
| 5,208,935 | A | * | 5/1993 | Jailor et al. | 15/41.1 |
| 5,319,819 | A | * | 6/1994 | Yoshizawa | 15/41.1 |
| 5,361,447 | A | | 11/1994 | Ophardt | |
| 5,664,276 | A | * | 9/1997 | Arias | 15/42 |
| 5,896,611 | A | * | 4/1999 | Haaga | 15/42 |
| 5,920,939 | A | * | 7/1999 | Worwag | 15/41.1 |
| 5,970,558 | A | * | 10/1999 | Canavan et al. | 15/41.1 |
| 6,530,106 | B1 | * | 3/2003 | Brundula | 15/182 |
| 6,845,538 | B2 | * | 1/2005 | Nakamura | 15/41.1 |
| 7,048,804 | B2 | | 5/2006 | Kisela et al. | |
| 7,143,461 | B2 | * | 12/2006 | Spooner | 15/41.1 |
| 7,152,267 | B2 | | 12/2006 | Kaleta | |
| 7,340,795 | B2 | | 3/2008 | Kaleta | |
| 7,496,984 | B2 | | 3/2009 | Pang | |
| 7,591,039 | B2 | | 9/2009 | Kaleta et al. | |
| 7,617,557 | B2 | * | 11/2009 | Reindle | 15/41.1 |
| 8,214,960 | B1 | * | 7/2012 | Rupp | 15/41.1 |
| 2004/0143919 | A1 | * | 7/2004 | Wilder | 15/41.1 |
| 2004/0187236 | A1 | * | 9/2004 | Tawara et al. | 15/48 |
| 2004/0205915 | A1 | * | 10/2004 | Sin et al. | 15/48.1 |
| 2005/0115409 | A1 | * | 6/2005 | Conrad | 95/271 |
| 2005/0155169 | A1 | * | 7/2005 | Cheah et al. | 15/42 |
| 2006/0242775 | A1 | | 11/2006 | Ho | |
| 2009/0044351 | A1 | * | 2/2009 | Menrik et al. | 15/21.1 |
| 2009/0077761 | A1 | | 3/2009 | Kaleta et al. | |
| 2009/0097907 | A1 | | 4/2009 | Blom | |
| 2009/0229075 | A1 | * | 9/2009 | Eriksson | 15/383 |
| 2011/0202175 | A1 | * | 8/2011 | Romanov et al. | 700/250 |

FOREIGN PATENT DOCUMENTS

| | | | | | |
|---|---|---|---|---|---|
| CN | 2917533 | Y | | 7/2007 | |
| GB | 2231778 | A | * | 11/1990 | A47L 11/33 |
| GB | 2434743 | A | | 8/2007 | |
| WO | 2007177067 | A1 | | 12/2007 | |
| WO | 2009077169 | A2 | | 6/2009 | |

* cited by examiner

FLOOR SWEEPER WITH SPLIT BRUSH ASSEMBLY

CROSS-REFERENCE TO RELATED APPLICATION

This application claims the benefit of U.S. Provisional Patent Application No. 61/246,365, filed Sep. 28, 2009, which is incorporated herein by reference in its entirety.

BACKGROUND OF THE INVENTION

1. Field of the Invention

This invention relates to sweepers. In one aspect, the invention relates to a sweeper with a dust bin accessible from the top of the sweeper for facile removal and emptying of the dust bin. In another aspect, the invention relates to a sweeper with enhanced mobility and cleaning ability.

2. Description of the Related Art

Sweepers are well known devices for removing dirt, dust, and other debris from a floor surface. Typically, sweepers comprise a foot or base assembly with at least one primary agitator, such as a horizontal axis brush roll. The agitator can be power driven, such as by a motor. An exemplary powered floor sweeper wherein a rotating sweeper brush is rotated by a direct current electric motor is disclosed in U.S. Pat. No. 4,369,539 to Nordeen. In Nordeen '539, a cavity at a rear end of the sweeper houses a DC motor and a battery supply to provide power for the motor.

Alternatively, sweepers can be driven by manual propulsion. Typically, manually-propelled sweepers have one or more driving wheels operatively coupled to the agitator and configured to contact the floor surface. As a user pushes the sweeper across the floor surface, the driving wheels rotate and then impart the rotation to the agitator. Most commonly, one or more driving wheels are coupled directly to the agitator for rotation therewith. In one well-known arrangement, a pair of driving wheels is directly connected to the agitator, and the wheels are positioned on opposite sides of the agitator. If the sweeper is turned sharply, the wheel positioned on the outermost edge of the turn radius is required to cover a longer distance than the inner wheel.

In addition to the primary agitator, floor sweepers can include edge agitators, also driven by manual propulsion or some other means. An exemplary manual propulsion floor sweeper having, in addition to its main brush roller, one or more auxiliary brushes for sweeping debris into the path of the main brush is disclosed in U.S. Pat. No. 3,978,539 to Yonkers. In Yonkers '539, auxiliary brushes are located at the forward corners of the sweeper housing and rotate in a direction to throw debris along the edge of the sweeper housing towards the middle of sweeper housing where the debris can be picked up by the main rotating brush. Other patents disclosing edge brushes include, for example, U.S. Pat. No. 500,976 to Tangenberg; U.S. Pat. No. 3,750,215 to Liebscher; U.S. Pat. No. 3,818,532 to Leifheit et al.; and U.S. Pat. No. 4,484,371 to Pätzold et al.

Usually, the primary agitator throws the dirt, dust, and other debris into a dust bin. In some sweepers, the dust bin is a cavity that can be emptied by opening a panel in the sweeper housing. Other sweepers comprise a separate dust bin mounted in the sweeper housing, and the dust bin can be removed from the sweeper for emptying. For example, Great Britain U.S. Pat. No. 1,442,587 to Moulinex discloses a sweeper with a separate dust bin that can be removed from the sweeper housing after lifting a cover on the sweeper housing to gain access to the dust bin.

Sweepers also comprise a handle assembly pivotally mounted to the foot assembly for moving the sweeper across the surface to be cleaned. When the sweeper is not in use, the user can rest handle assembly against a wall for storage, or the sweeper can preferably include a mechanism for retaining the handle assembly in a generally vertical storage position. Examples of such retaining mechanisms are disclosed in, for example, U.S. Pat. No. 5,361,447 to Ophardt; U.S. Pat. No. 2,057,181 to Bloom; U.S. Pat. No. 255,823 to Soper, U.S. Pat. No. 2,406,247 to Owen; U.S. Pat. No. 2,975,450 to Williams; U.S. Pat. No. 3,034,163 to Stevens; U.S. Pat. No. 4,168,561 to Rosendall; and U.S. Pat. No. 5,208,935 to Jailor Customarily, the sweeper handle assembly comprises an elongated stick-like portion that can be grasped by a user while standing an upright position. A segmented upright pivotal handle for a vacuum cleaner is disclosed in U.S. Pat. No. 6,345,411 to Kato et al., wherein upper handle segments can be removed so that the vacuum cleaner can be utilized as a hand held unit in addition to a conventional upright unit.

SUMMARY OF THE INVENTION

A floor sweeper for recovering material from a surface to be cleaned comprises a foot assembly adapted to move across a surface to be cleaned and including a housing forming a brush chamber having a bottom opening. The floor sweeper further comprises a pair of driving wheels mounted to the housing for supporting the housing above the surface to be cleaned, each driving wheel including a driving gear; and a split brush assembly rotatably mounted within the housing brush chamber and adapted to contact the surface through the opening, the brush assembly including two independently mounted brushes mounted to the brush chamber mounted for rotation within the brush chamber independent of each other; each of the brushes having a brush gear that is in registry with one of the driving gears. Each driving wheel drives one of the two brushes independently of the other brush so that the brushes can be rotated at different speeds as the foot assembly moves along the floor.

In one embodiment, each of the brushes includes paddles that are adapted to contact the surface to be cleaned during rotation and pick up dirt and debris.

In another embodiment, the floor sweeper further comprises a dirt receptacle mounted to the housing and in registry with the brushes to receive dirt and debris from the brushes as the foot assembly moves across the surface to be cleaned. Additionally, the dirt receptacle can be transparent and comprises two dirt cavities, each of which is in communication with one of the two independently mounted brushes. The housing forms passages between the two dirt cavities and the two independently mounted brushes and each of the passages has a guide for guiding dirt and debris from the independently mounted brushes to the two dirt cavities. The guide separates each of the passages into two vertically juxtaposed upper and lower dirt passages. Further, the brush chamber can be configured to guide dirt and debris from the surface to be cleaned to the upper dirt passage or the lower dirt passage dependent on the rotational direction of the brushes. Also, each of the two dirt cavities can have a slot that is configured to receive a portion of one of the driving wheels.

In another embodiment, the dirt receptacle has a pair of slots, each of which is configured to receive a portion of one of the driving wheels. In yet another embodiment, the housing forms passages between the dirt receptacle and the two independently mounted brushes and each of the passages has a guide for guiding dirt and debris from the independently mounted brushes to the dirt receptacle. The guide separates each of the passages into two vertically juxtaposed upper and lower dirt passages. The brush chamber is configured to guide dirt and debris from the surface to be cleaned to the upper dirt passage or the lower dirt passage dependent on the rotational direction of the brushes.

In another embodiment, the floor sweeper's driving wheels comprise gear teeth on each side of the outer periphery thereof, and the brush has corresponding brush gear that drivingly engages the gear teeth on the driving wheel. Each of the brush gears is spaced inwardly of an outer end of the brush and portions of the brush extend between each brush gear and the corresponding outer end of the brush.

In yet another embodiment, the floor sweeper further comprises a handle that is pivotally mounted to the foot assembly, and the foot assembly further comprises rollers on the forward and rear portions thereof for supporting the foot assembly on a surface to be cleaned, and wherein the forward rollers are longitudinally aligned with the brush gears.

DESCRIPTION OF THE PREFERRED EMBODIMENTS

Figure 1:
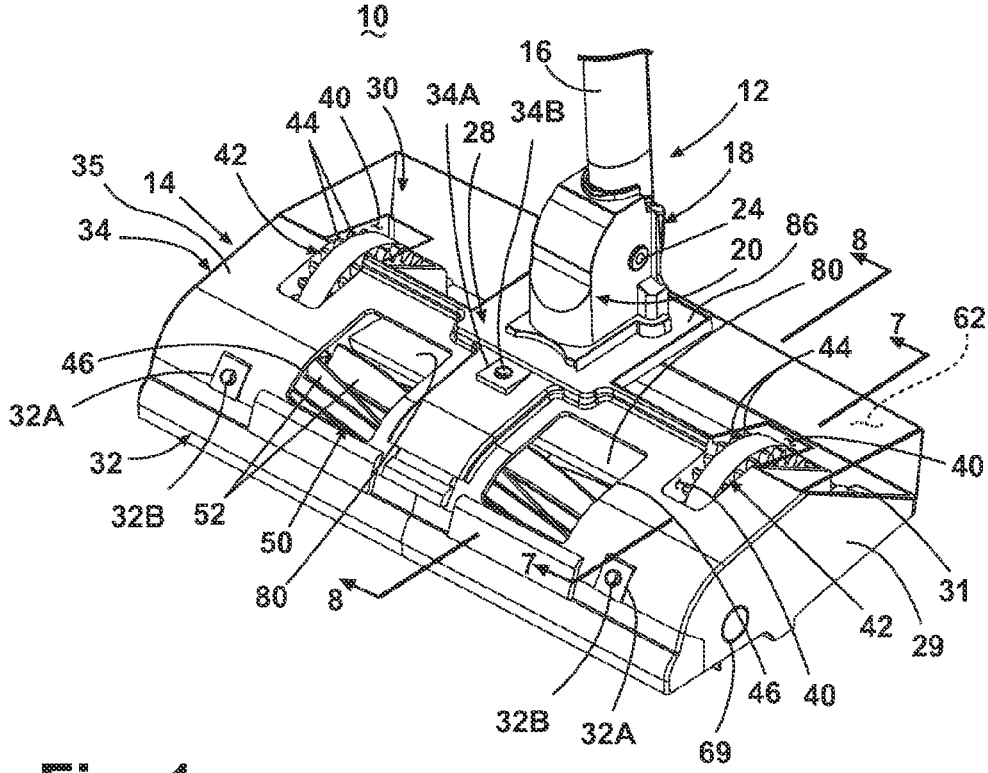
FIG. 1 is partial a front perspective view of a floor sweeper according to the invention.

Referring to the drawings and to FIG. 1 in particular, a sweeper 10 according to the invention comprises a handle assembly 12 pivotally mounted to a base or foot assembly 14. The handle assembly 12 can comprise any type of elongated handle suitable for the purposes described herein and can be adapted to pivot about one or more axes. For example, the handle assembly 12 can be pivoted about a horizontal axis from an upright, vertical position wherein the handle assembly 12 is substantially vertical relative to the surface to be cleaned, through an angle to a lowered position. An exemplary angle can be between 30 and 90 degrees. The handle assembly 12 can optionally be configured so as to swivel about its longitudinal axis when in the lowered position.

Figure 2:
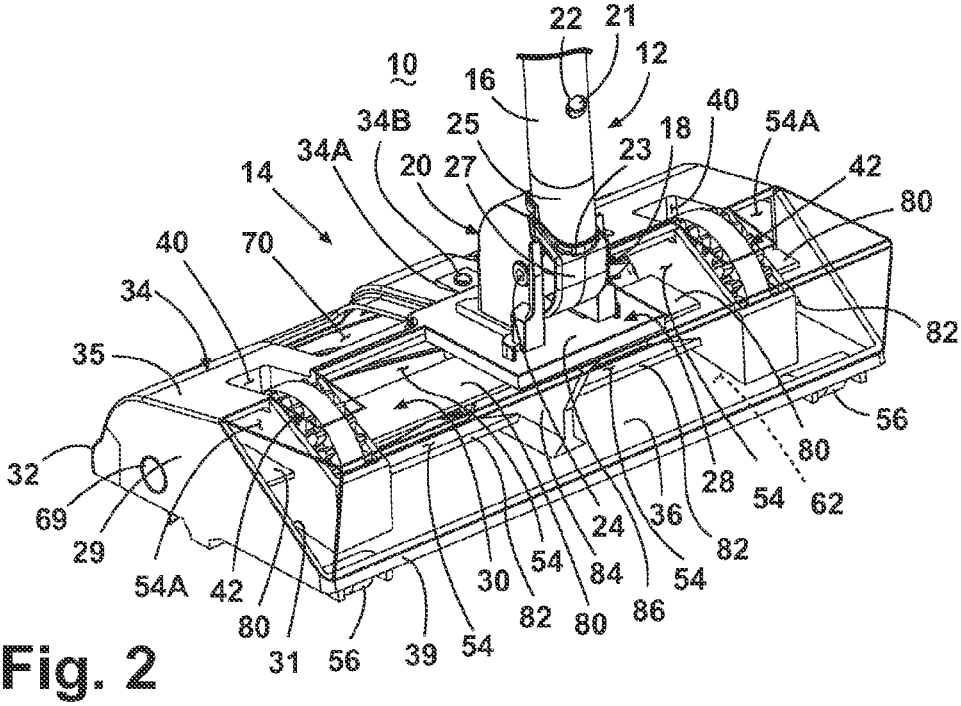
FIG. 2 is a partial rear perspective view of the floor sweeper of FIG. 1.

For exemplary purposes, a conventional handle assembly 12 comprises an elongated handle portion 16, both of which are partially illustrated in FIGS. 1 and 2. The handle portion 16 can comprise a hand grip (not shown) adapted to comfortably fit a user's hand. The elongated handle portion 16 can be integrally formed or can comprise a plurality of interconnected handle segments. In other potential embodiments, the handle portion 16 can comprise a telescoping handle having an articulating handle joint accessible when the handle portion 16 is fully extended.

Figure 7:
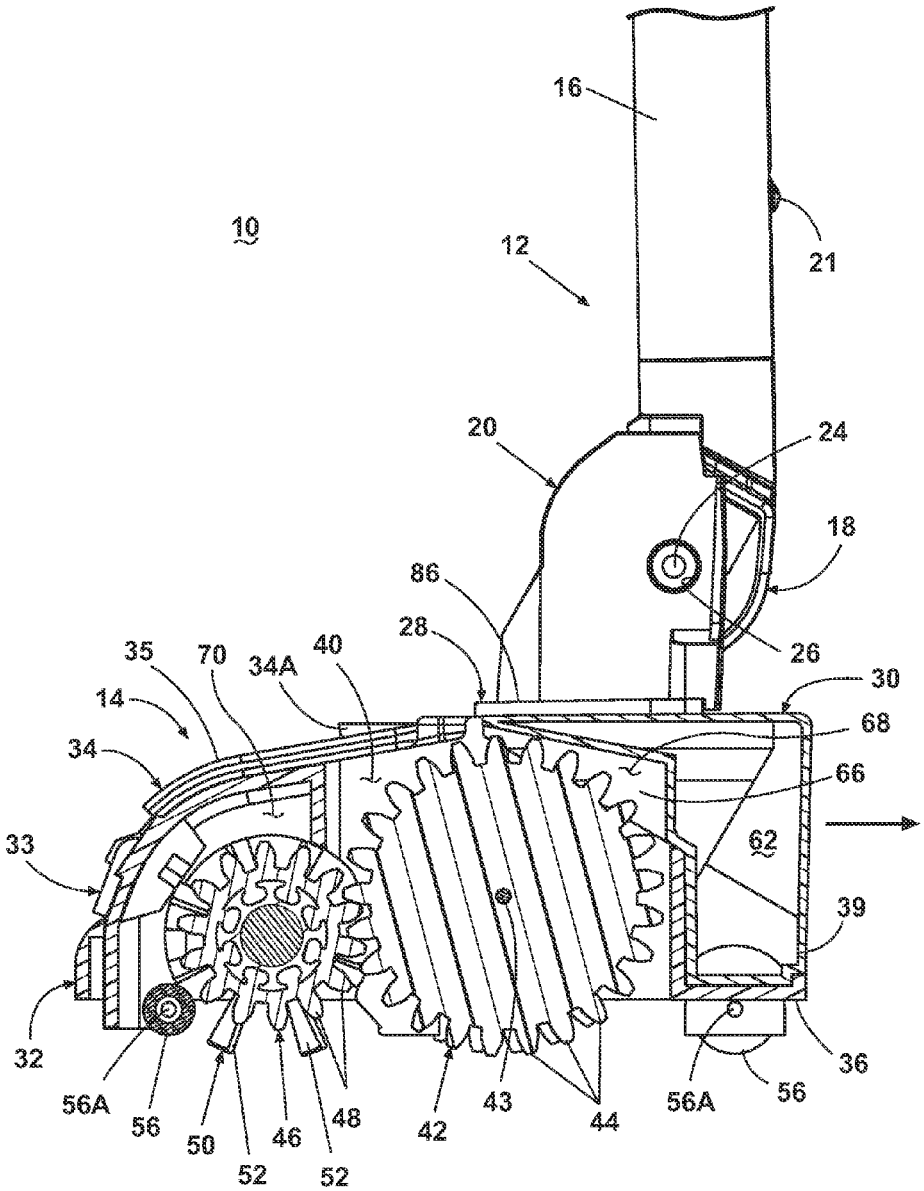
FIG. 7 is a partial sectional view of the floor sweeper taken along line 7-7 of FIG. 1.
Figure 8:
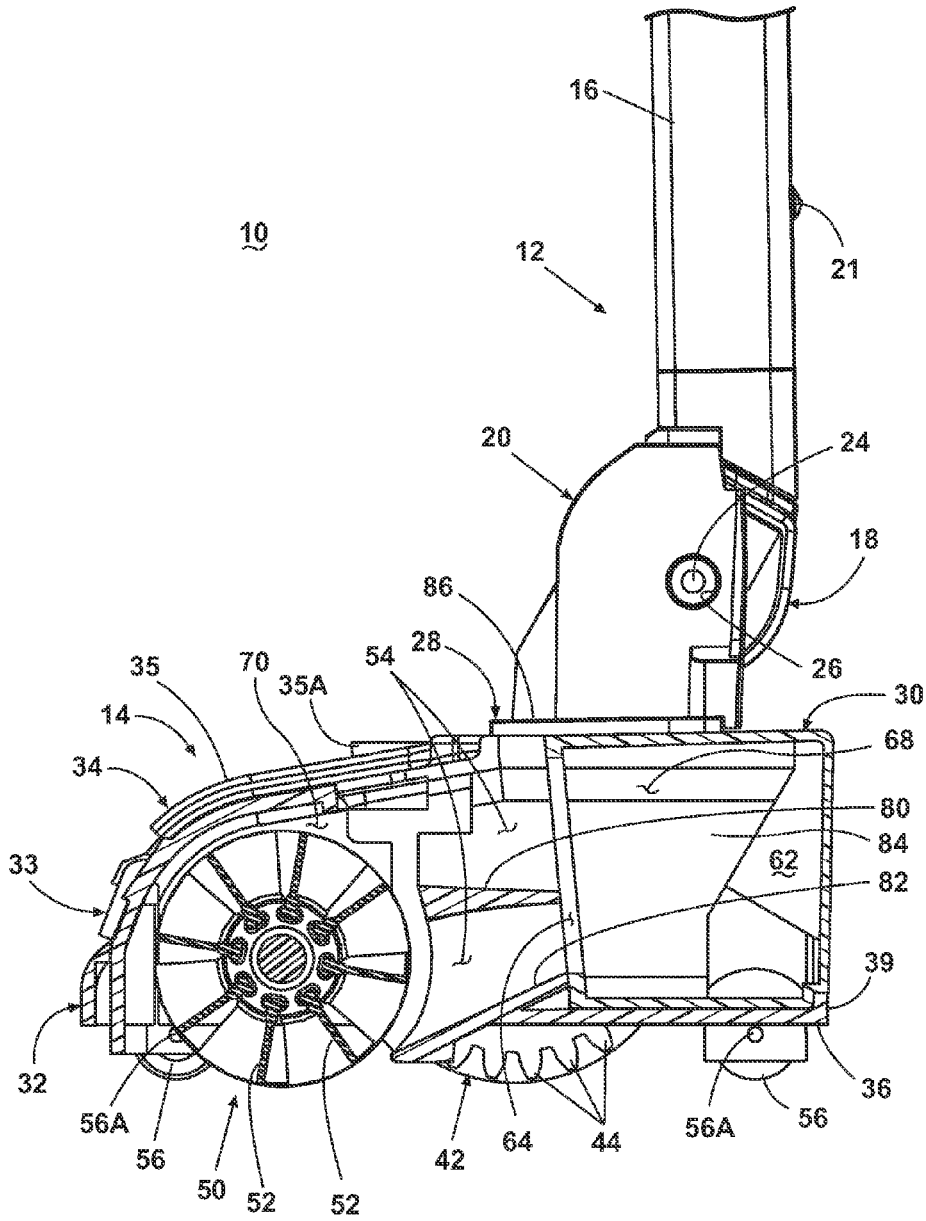
FIG. 8 is a partial sectional view of the floor sweeper taken along line 8-8 of FIG. 1.

The handle assembly 12 further comprises one or more connecting elements adapted for connection to one or more corresponding connecting elements of the foot assembly 14. In the illustrated example, the handle assembly 12 includes connecting elements in the form of a handle knuckle 18 and a handle connector 20 adapted to pivotably receive the handle knuckle 18. The handle knuckle 18 comprises a handle projection 21 and the handle portion 16 comprises a handle aperture 22 formed at a lower end of the handle portion 16. The handle assembly 12 can be pivotally connected to the foot assembly 14 by installing the handle portion 16 over the knuckle 18, upon which the handle projection 21 is received and retained within the handle aperture 22. The handle knuckle 18 further comprises two axially-opposite pivot projections 24 configured for rotatable receipt within corresponding opposed engagement apertures 26 (FIG. 7) formed in the handle connector 20. A swivel joint 23 can permit an upper portion 25 of the handle knuckle 18 to swivel along the longitudinal axis of the handle portion 16 with respect to a lower portion 27 of the knuckle 18.

The foot assembly 14 includes a connecting element in the form of a connection support 28 upon which the handle assembly 12 can be mounted to the foot assembly 14 at a rear portion of the foot assembly 14. The connection support 28 can be centered on a longitudinal axis of the foot assembly 14 so as to provide optimal maneuverability of the foot assembly 14 via the handle assembly 12. Alternatively, the handle assembly 12 can be adapted for attachment to the foot assembly 14 using any suitable connection mechanism, such as but not limited to a handle yoke on the handle assembly adapted to connect to the foot assembly at two different points, or a universal joint.

Figure 3:
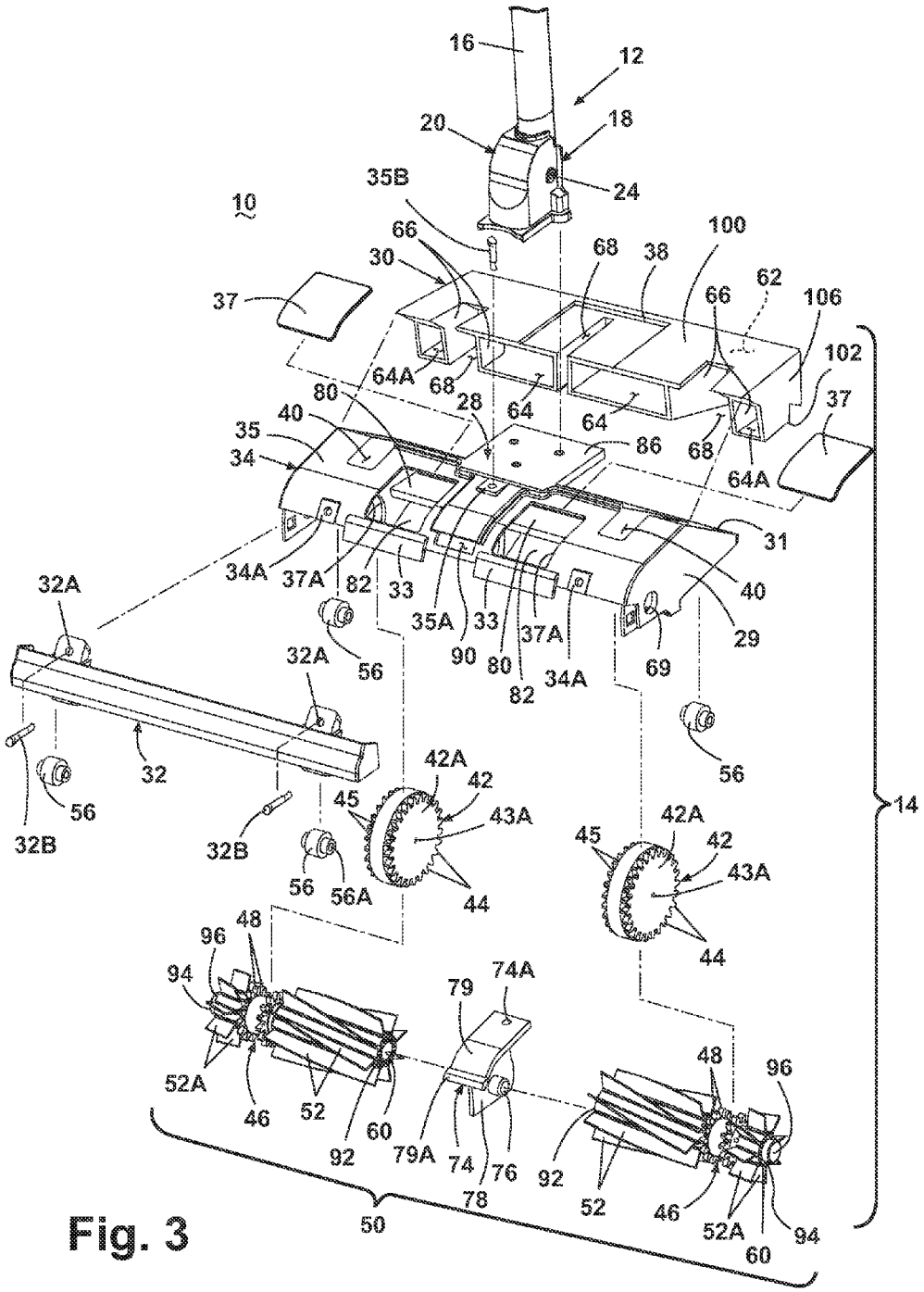
FIG. 3 is a partial exploded view of the floor sweeper of FIG. 1.
Figure 4:
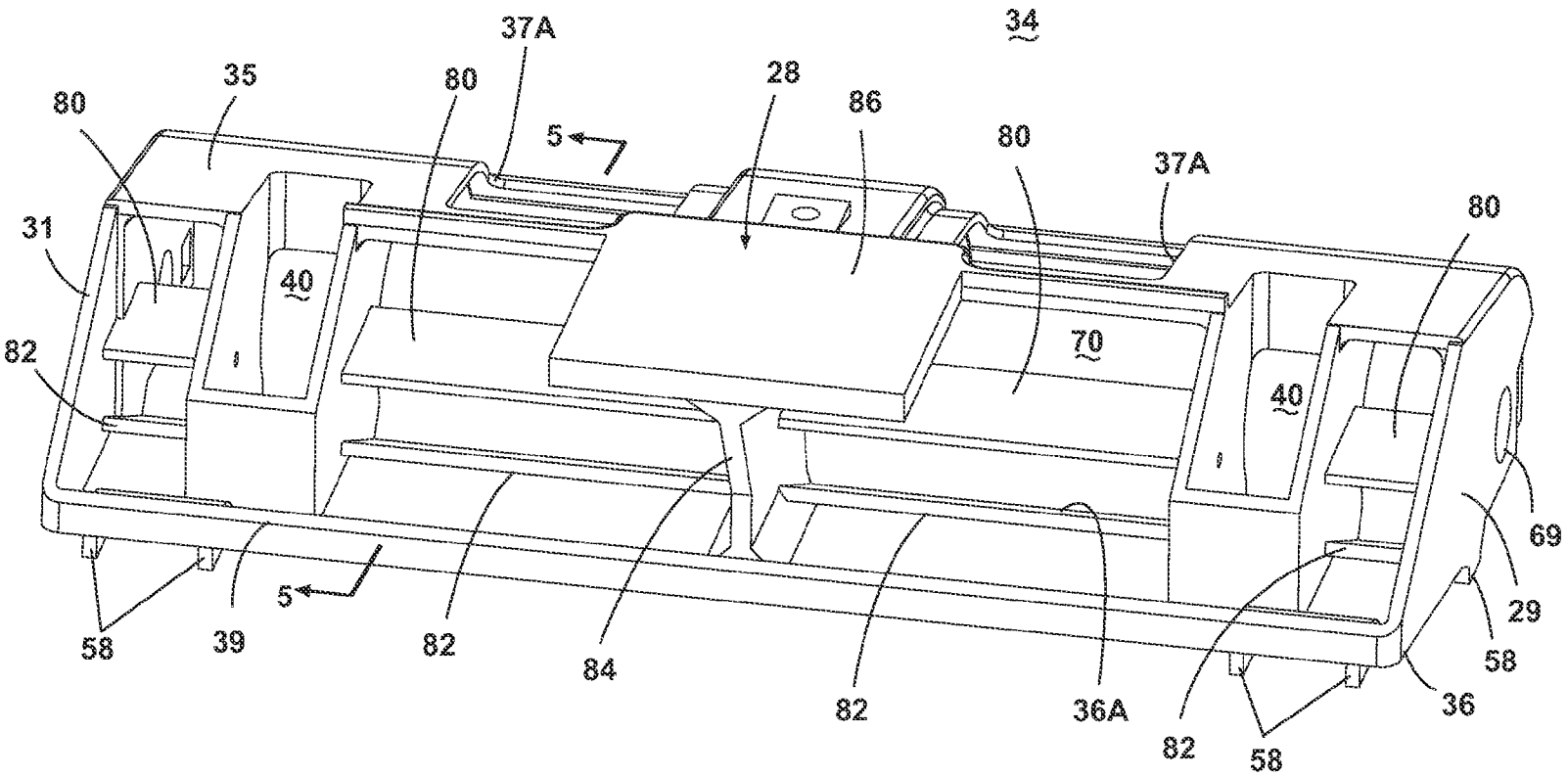
FIG. 4 is a rear, isometric view of a housing of the floor sweeper of FIG. 1.
Figure 5:
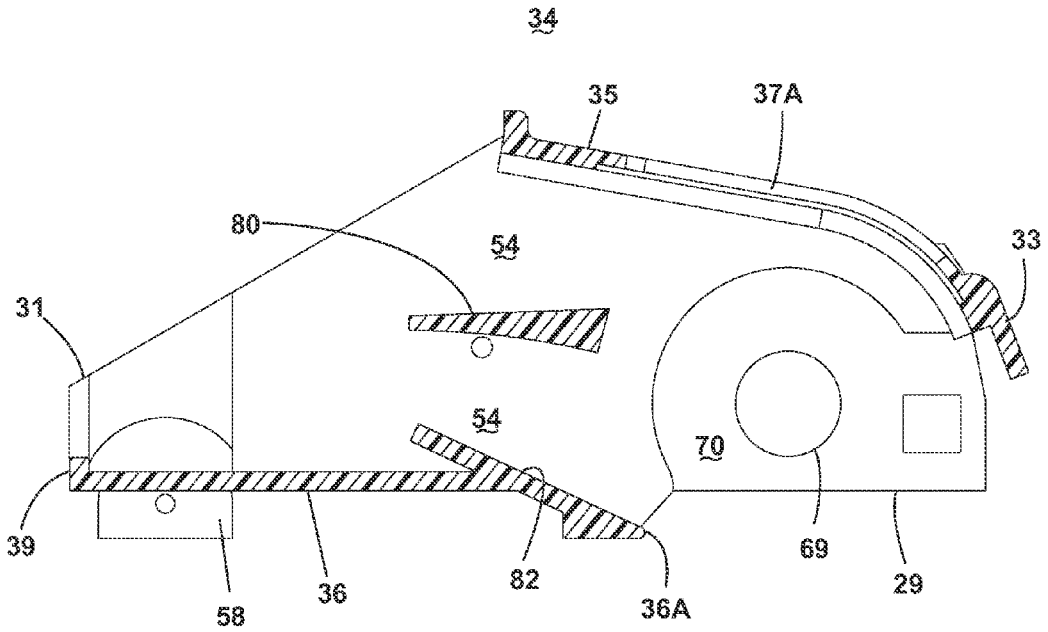
FIG. 5 is cross sectional view taken along line 5-5 of the housing of FIG. 4.

Referring to FIGS. 3-5, the foot assembly 14 comprises a housing 34, a dirt cup 30, and a bumper 32. The housing 34 comprises an upper wall 35, a lower wall 36, and two side housing walls 29 and can be integrally formed of any material suitable for the purposes described herein, such as a durable and lightweight molded plastic. The upper housing wall 35 curves gradually upward and rearward from a foremost portion of the housing 34 and the lower housing wall 36 is a generally flat member that partially encloses the bottom of the housing 34. Axially-opposed side housing walls 29 extend vertically between the upper housing wall 35 and the lower housing wall 36 and taper downwardly from the rear of the upper housing wall 35 to a rear wall 39. The rear wall 39 is positioned at a rear most portion of the housing 34 and spans the length of the lower housing wall 36. The rear wall 39 extends a relatively short distance vertically upward from the lower housing wall 36. Together, the rear of the upper housing wall 35, the tops of the tapered portions of the side housing walls 29, and the top of the rear wall 39 define a rear opening bounded by a perimeter edge 31.

The housing 34 further comprises a brush chamber 70 adapted to house a split brush assembly 50. The brush chamber 70 is positioned at a forward portion of the foot assembly 14 and is formed between the upper wall 35 and the side walls 29. The lower housing wall 36 is relatively horizontal at a rear portion and forms at a forward portion a downwardly sloping ramp that terminates in a forward edge 36A that defines an opening in the bottom wall at a rear portion of the brush chamber 70 so as to enable a portion of the split brush assembly 50 housed within the brush chamber 70 to project through the bottom wall opening and contact the surface to be cleaned.

Figure 9:
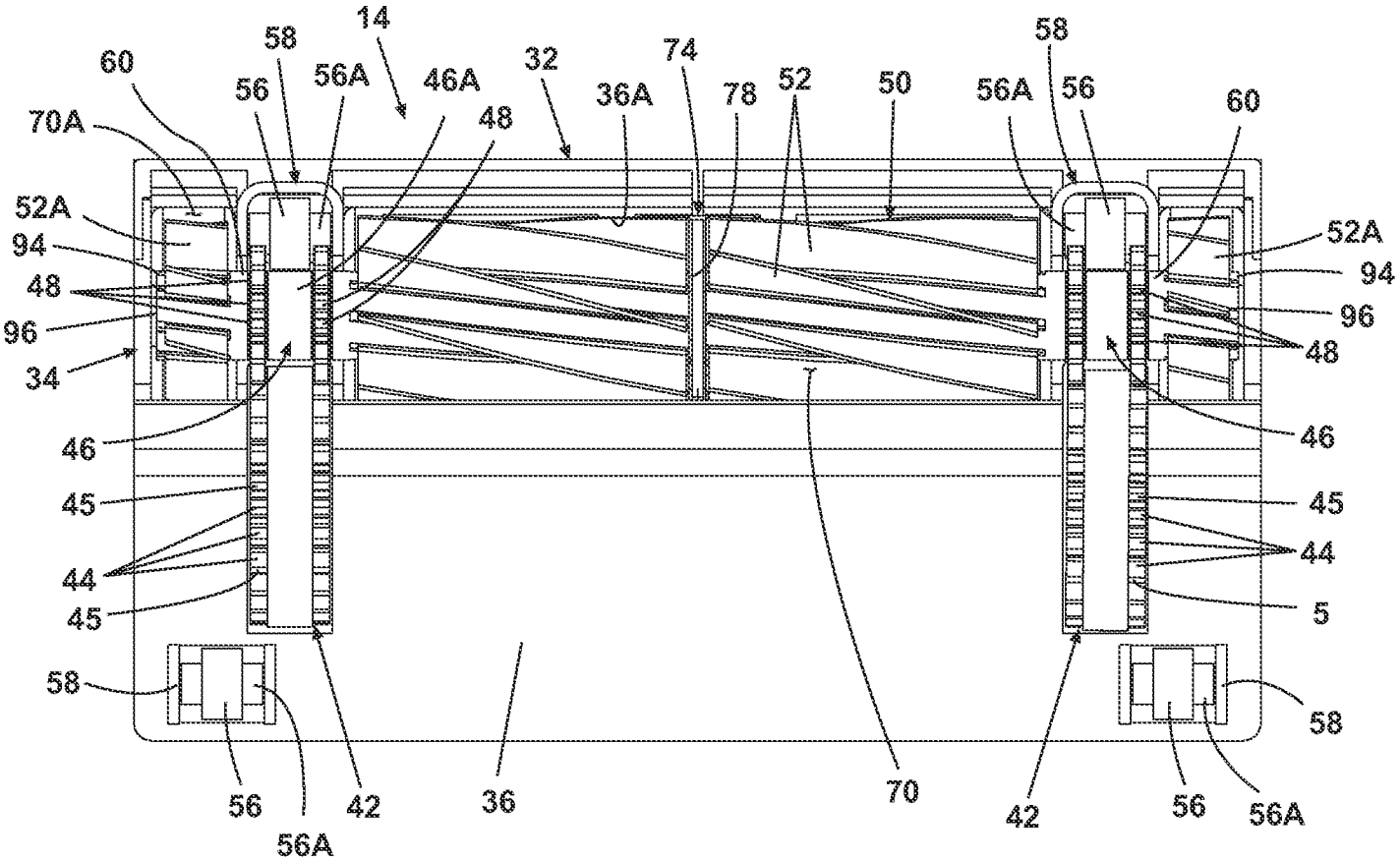
FIG. 9 is a bottom plan view of a foot assembly of the floor sweeper of FIG. 1.

The lower housing wall 36 further four roller housings 58, as best seen in FIG. 9. Each roller housing 58 comprises a recess formed in the lower housing wall 36 as well as a plurality of downwardly-extending, relatively short walls that extend from a lower surface of the lower housing wall 36 and include through holes for receiving a pin for mounting a roller 56. The roller housings 58 are arranged in opposed pairs, with one pair positioned near the forward portion of the foot assembly 14, and the other pair positioned near the rearward portion of the foot assembly 14. Each of the roller housings 58 is adapted to rotatably mount one of four corresponding rollers 56 and is leveled such that the rollers 56 will contact the surface to be cleaned so as to enable rolling movement of the foot assembly 14 there upon. The rollers 56 can be mounted to the roller housings 58 in any suitable manner, such as by inserting pins (not shown) through central bores 56A formed in each roller 56 and the holes through the corresponding walls of the roller housings 58.

Referring again to FIGS. 3-5, the foot assembly 14 further comprises two clear windows 37 adapted for mounting within corresponding window cutouts 37A that are formed in a forward portion of the housing 34. The windows 37 are positioned above the brush chamber 70 for viewing the split brush assembly 50. The windows 37 and window cutouts 37A can have any shape that enables a user to view the contents of the brush chamber 70 therethrough, such as the illustrated generally rectangular shape. The windows 37 can be mounted within the window cutouts 37A in any suitable manner, such as by using sonic welding, adhesive, or mechanical fasteners, or via a snap fit. Alternatively, the entire upper housing wall 35 or even the entire housing 34 can be formed of a transparent material.

The housing 34 further comprises spaced pockets 40 formed therein that are each adapted to rotatably receive one of two driving gears 42. The pockets 40 extend through both the upper housing wall 35 and the lower housing wall 36 and are longitudinally aligned with the forward roller housings 58. The pockets 40 are also configured such that when the driving wheels 42 are mounted in the pockets 40, the bottommost portions of the driving wheels 42 are coplanar with the bottommost portions of the rollers 56 so as to simultaneously contact the surface to be cleaned and rotate as the foot assembly 14 is moved across the surface to be cleaned. The pockets 40 are spaced forwardly of the rearward pair of rollers 56.

The driving wheels 42 each have a substantially wheel-like body 42A and comprise a plurality of conventional driving wheel teeth 44. The driving wheels 42 can be mounted in the pockets 40 in any suitable manner, such as by inserting pins 43 (FIG. 7) through center holes 43A (FIG. 3) formed in both of the driving wheels 42. Optionally, a pair of mounting brackets (not shown) can be attached to the housing 34 and can be used to rotatably mount each of the driving wheels 42 in the pockets 40.

Figure 6:
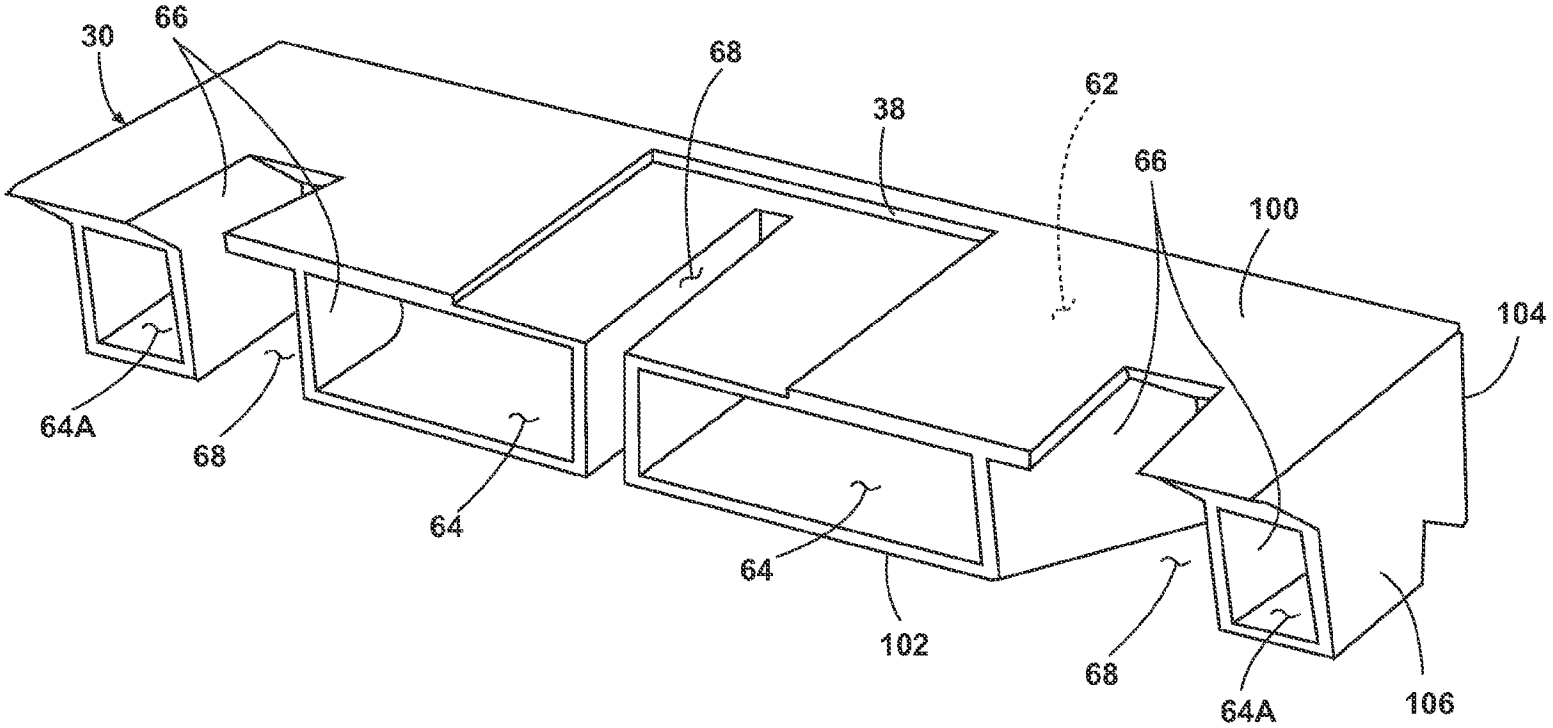
FIG. 6 is an isometric view of a dirt cup of the floor sweeper of FIG. 1.

Referring now to FIGS. 3 and 6, the dirt cup 30 is configured to receive material, such as dirt or other debris, recovered by the sweeper 10 therein. The dirt cup 30 can be removably mounted to and received at least partially within a rear portion of the housing 34 through the rear opening of the housing 34 defined by the perimeter edge 31. The dirt cup 30 can be integrally formed of a relatively resilient and durable transparent or translucent material so as to enable a user to view the contents of the dirt cup 30 to determine when the dirt cup 30 should be detached from the housing 34 and emptied. The dirt cup 30 is a generally rectangular member having one substantially open face and comprises a top wall 100, a bottom wall 102, a rear wall 104, and a pair of side walls 106, which together define a dirt cup cavity 62 therein. The dirt cup 30 deviates from truly rectangular in several locations at which it is interrupted, the purpose of which will be described in detail hereinafter. The dirt cup cavity 62 is partially segmented into a pair of inner dirt cup cavities 64 and a pair of outer dirt cup cavities 64A. The inner and outer dirt cup cavities 64, 64A are formed by a plurality of vertical slot walls 66, the top wall 100, and the bottom wall 102. The spaces outside the cavities 64, 64A and between the pairs of vertical side walls 66 define a plurality of open slots 68 that extend through the top and bottom walls 100, 102. In other words, the inner and outer dirt cup cavities 64, 64A are separated by the slots 68 which segment the dirt cup cavity 62. The slots 68 are adapted to align with corresponding pockets 40 in the housing 34 when the dirt cup 30 is mounted thereto and are sized to receive the driving wheels 42 when the driving wheels 42 are mounted in the pockets 40, and thus do not interfere with the driving wheels 42.

The dirt cup 30 further comprises a depression 38 in the top wall 100 that is adapted to slidably engage the connection support 28 therein. Alternatively, the dirt cup 30 can be replaced by a flap (not shown) pivotally attached to the foot assembly 14 along the back edge of the top wall 35 of the rear housing and configured to selectively close the dirt cup cavity 62 around the perimeter edge 31.

Referring to FIGS. 3-5 and 8, each of the inner dirt cup cavities 64 and outer dirt cup cavities 64A is adapted to align with a corresponding inner dirt passage 54 and outer dirt passage 54A, respectively, in the interior of the housing 34 so as to transfer recovered material to the dirt cup 30. The inner and outer dirt passages 54, 54A fluidly connect the brush chamber 70 and the dirt cup cavity 62. The inner and outer dirt passages 54, 54A are formed in the housing 34 by a relatively thin upper guide 80 and lower guide 82. The guides 80 and 82 are vertically spaced and are angled slightly toward each other so as to direct and retain dirt recovered by the split brush assembly 50 within the dirt cup cavity 62. The lower guide 82 extends upward and rearward at an angle from the forward edge 36A of the lower housing wall 36. The upper guide 80 is spaced vertically between the lower housing wall 36 and the upper housing wall 35 and extends slightly downward and rearward. The upper and lower guides 80 and 82 extend between the side housing walls 29 but are interrupted by each of the two pockets 40. That is to say that there is a void in the guides 80, 82 where they intersect the pockets 40. Dirt passages 54 and 54A are formed between the upper guide 80 and the lower guide 82 and between upper guide 80 and the upper housing wall 35. The lower guide 82 is upwardly-angled to prevent recovered material in the dirt cup cavity 62 from moving back through the dirt passages 54, 54A and brush chamber opening 36A onto the surface to be cleaned.

The housing 34 further includes the connection support 28, which comprises a vertical support wall 84 and a coupling plate 86. The vertical support wall 84 extends downward from the bottom face of the coupling plate 86 and is formed integrally with the coupling plate 86. The vertical support wall 84 can comprise a relatively thin plate or wall having a widened base portion for providing additional structural support. The coupling plate 86 is a substantially thin and flat plate with an upper surface configured to mount the handle connector 20 thereupon. The vertical support wall 84 extends substantially the entire length of the coupling plate 86. The coupling plate 86 extends substantially horizontally and rearwardly from the upper housing wall 35 at the perimeter edge 31 to a position forward of the rear wall 39, as can best be seen in FIGS. 7 and 8. The handle connector 20 can be attached to the coupling plate 86 in any suitable manner, such as by gluing, welding, or using mechanical fasteners (not shown). Although the connection support 28 is illustrated and described as being integral with a housing 34, it can also be formed separately and coupled to the housing 34 in any suitable manner.

Figure 10:
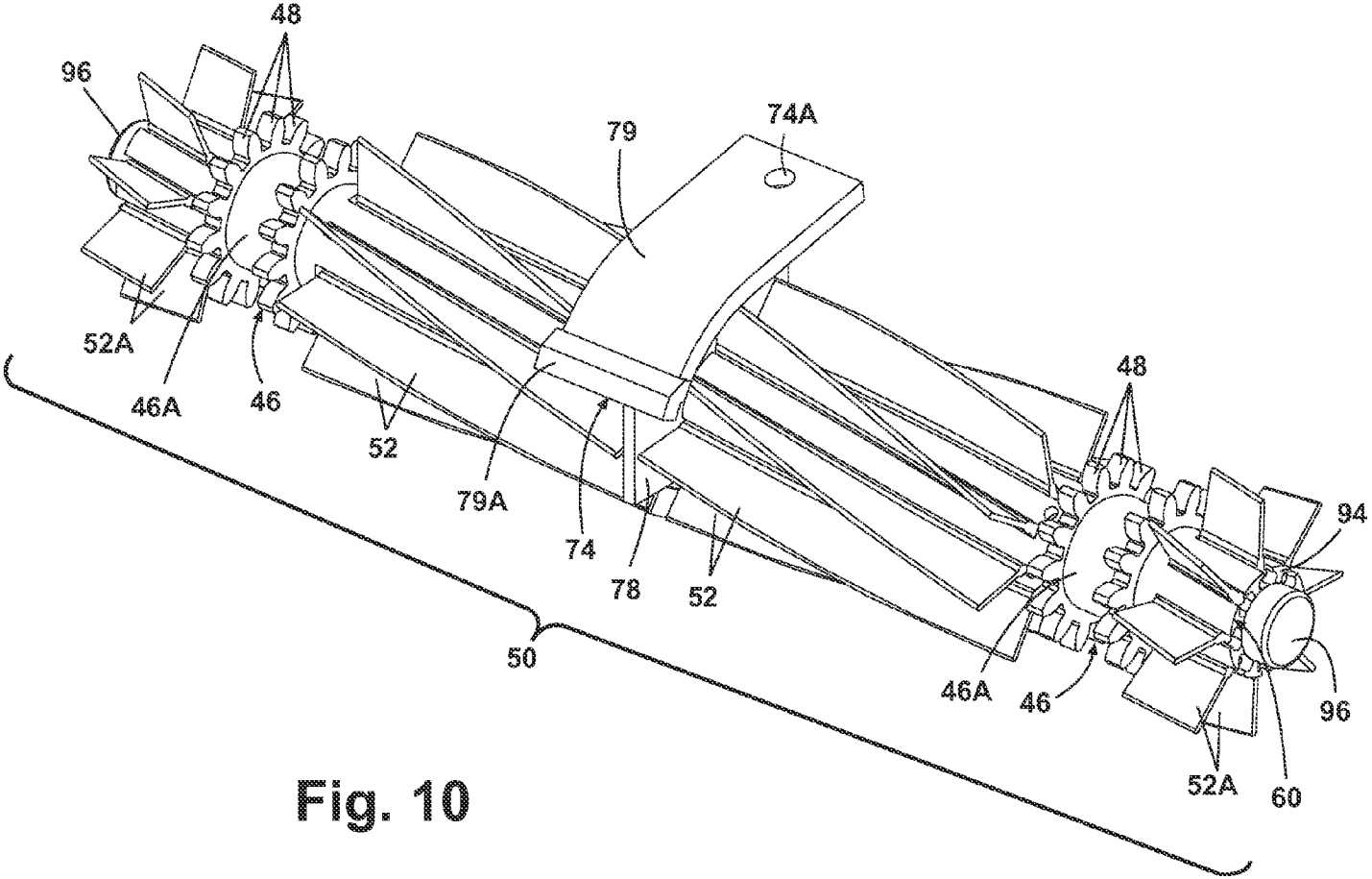
FIG. 10 is an enlarged perspective view of a brush assembly of the floor sweeper of FIG. 1.

Referring now to FIGS. 3 and 9-10, the split brush assembly 50 is mounted in the housing 34 within the brush chamber 70 and is adapted to contact the surface to be cleaned. The split brush assembly 50 comprises two opposed identical halves, each positioned on opposite sides of a brush support 74. Each half of the split brush assembly 50 comprises a rotatable support in the form of brush core 60, which comprises a substantially cylindrical and hollow rod. Each half of the split brush assembly 50 further comprises a brush core end insert 96 adapted to be partially received within an outer end 94 of the brush core 60. Additionally, a bearing (not shown) can be included between each end insert 96 and outer end 94 in order to facilitate rotation of the brush core 60 about the end insert 96. Alternatively, a bearing can be included within each aperture 69 so as to enable to end inserts 96 to rotate therein along with the brush cores 60. The brush cores 60 can each be integrally molded of a suitably durable plastic.

The brush cores 60 can be mounted axially-opposite one another within the brush chamber 70, each positioned between the brush support 74 and the side housing wall 29. A brush aperture 69 is formed in the side housing wall 29 for receiving the end insert 96 by which to rotatably mount the brush core 60 to the side housing wall 29.

The brush support 74 comprises a relatively thin vertical wall 78 having opposed projections 76 located on opposite sides thereof. The projections 76 are adapted for insertion into inner ends 92 of the brush cores 60 for rotatably mounting the brush cores 60 to the brush support 74. A bearing (not shown) can be included between each projection 76 and inner end 92 in order to facilitate rotation of the brush core 60. The vertical wall 78 can have any suitable shape, such as the illustrated slightly curved and substantially rectangular shape. A brush support top 79 is centered atop the vertical wall 78 and is adapted to be positioned against the underside of the upper housing wall 35 of the housing 34 such that a top tab 79A of the brush support top 79 extends through a tab-receiving aperture 90 formed in the upper housing wall 35. The brush support top tab 79 further comprises a connecting aperture 74A configured to align with a corresponding upper housing connector 35A adapted for connection to the housing 34 in any suitable manner. As illustrated, the connecting aperture 74A can be coupled to the upper housing connector 35A using a mechanical fastener, such as but not limited to a pin 35B. The brush support 74 can be formed of any suitable material, such as a molded plastic.

A plurality of inner paddles 52 and outer paddles 52A are affixed about each brush core 60 in a commonly known manner, such as by forming grooves or other features adapted to receive the paddles 52, 52A in the brush core 60. The inner paddles 52 are spaced from the outer paddles 52A in order to accommodate a brush gear 46 therebetween. Although the inner paddles 52 and outer paddles 52A are illustrated as having a substantially similar structure and configuration, the outer paddles 52 can alternatively have a different structure and/or configuration than the inner paddles 52. For example, the outer paddles 52A can be replaced by elongated tufts or bristles (not shown) that are directed laterally outwardly and that are adapted for removing material from edges or crevices.

The brush gear 46 of each half of the split brush assembly 50 comprises a brush gear body 46A having a plurality of brush gear teeth 48 extending outwardly about the circumference of the opposing sides thereof. The brush gear body 46A comprises a substantially hollow cylindrical member somewhat similar in structure to the brush core 60 and aligned with the brush core 60. As illustrated, the brush gear body 46A can have a slightly enlarged diameter relative to that of the rest of the brush core 60. The brush gear body 46A can have a diameter smaller than that of the driving gear body 42A, and the specific diameters of the driving wheel body 42A and brush gear body 46A can be selected so as to achieve a desired gear ratio. In other potential scenarios not described in detail herein, additional gears can also be incorporated to achieve various desired gear ratios.

The brush gear 46 is adapted to interface with the driving wheel 42. More specifically, the brush gear 46 interfaces with the driving wheel 42 by meshing conventional spur gear teeth 48 and 44, as is commonly known. The outer diameter of the driving wheel body 42A is larger than the outer diameter the driving wheel gear teeth 48 and thus protrudes into the space formed between the opposed brush gears 46, adjacent to the brush gear body 46A. The outer surface of the driving wheel body 42A is adapted to contact and roll along the cleaning surface, and thus can comprise various structural features or textures configured to increase friction with the cleaning surface. For example, the outer surface of the driving wheel 42 can comprise an elastomeric tread or the like.

The brush gears 46 can be formed integrally with the brush cores 60 as illustrated. Alternatively, the brush gears 46 can be formed separately from the brush cores 60 so long as the brush gears 46 are adapted for rotation therewith. For example, each brush core 60 can be formed in two pieces adapted to be coupled together by the brush gear 46, and the brush gear 46 can include a pair of projections (not shown) adapted to couple between both pieces of the brush core 60 via a snug fit within the hollow interiors of the pieces of the brush core 60.

The bumper 32 is positioned at a lower front portion of the housing 34. The bumper 32 can be formed separately from the housing 34 and affixed thereto by any suitable means, such as welding, gluing, or by a snap fit. As illustrated, the bumper 32 can comprise bumper connectors 32A adapted for connection to housing connectors 34A included on a lower forward portion of the housing 34 by any suitable means. For example, the bumper 32 can be coupled to the housing 34 using mechanical fasteners, such as but not limited to pins 32B. Alternatively, the bumper 32 can be integrally formed with the housing 34.

The bumper 32 can have any structure suitable for the function of absorbing impacts to the front of the housing 34. As illustrated, the bumper 32 can have a relatively rounded shape. Alternatively, the bumper 32 can comprise a flat surface, one or more projections, one or more cutouts, various textures, a lip, and any combination thereof, as well as any other shape or features suitable for the purposes described herein. The bumper 32 can be formed of any relatively resilient and durable material suitable for protecting the foot assembly 14 from damage by absorbing impacts. An exemplary material suitable for use in forming the bumper 32 is hard rubber.

Additional bumper portions 33 can be positioned above the bumper 32 and can extend longitudinally along portions of the bumper 32. The bumper portions 33 can be formed integrally with the housing 34 on a forward portion of the upper housing wall 35 thereof.

In operation, as the user pushes the foot assembly 14 along a surface to be cleaned via manipulation of the handle assembly 12, the rollers 56 and driving wheels 42 rotate due to friction with the surface to be cleaned. The rotation of each driving wheel 42 is transmitted separately to the corresponding brush gear 46 via the interaction between the driving wheel teeth 44 and the brush gear teeth 48. The brush gears 46 then transmit the rotation to the brush cores 60, which rotate via the bearings.

Rotation of the brush cores 60 drives the paddles 52, 52A to contact and agitate the surface to be cleaned and to throw dirt and debris loosened therefrom rearward into the dirt passages 54, 54A, respectively. The material moves through the dirt passages 54, 54A, through the dirt cup cavities 64, 64A, respectively, and into the dirt cup cavity 62. When the user determines that the dirt cup 30 is full of recovered material, the user can remove the dirt cup cavity 30 from the foot assembly 14 by pulling the dirt cup 30 outwardly from the housing 34 and can dispose of the material therein. Once the dirt cup 30 has been emptied, the user can replace the dirt cup 30 in the housing 34.

Depending on the speed and direction in which the foot assembly 14 is moved, the two driving wheels 42 can rotate at different speeds to rotate the halves of the split brush assembly 50 at different speeds relative to one another. For example, if the user maneuvers the foot assembly 14 around a corner or curve, the half of the split brush assembly 50 that is farthest from the point of rotation has a longer distance to travel relative to the half of the split brush assembly 50 nearest the point of rotation. Accordingly, the half of the split brush assembly 50 and corresponding drive gear 42 farthest from the point of rotation can rotate faster than the half of the split brush assembly 50 and the corresponding drive gear 42 nearest the point of rotation.

The use of the two separately-rotatable halves of the split brush assembly 50 prevents damage caused by non-linear movement of the foot assembly 14 that would occur if a unitary brush core were used. In conventional brush assemblies, which have only a single integral brush core, this type of movement causes damage to the brush assembly because the end of the brush core farthest from the point of rotation is rotationally constrained by the end of the brush core nearest the point of rotation. The outer end of conventional brush cores is thus unable to rotate at a faster speed relative to the inner end thereof in order to accommodate rotational movement of the sweeper 10, which produces drag and strain on the brush core. In addition, the inventive use of the driving wheels 42 and brush gears 46 serves to enhance the mobility and efficiency of the sweeper 10 as opposed to conventional friction-only sweepers by providing positive rotational movement to the brush cores 60.

Thus, the split brush sweeper 10 according to the invention provides a mechanism for driving two independently mounted brushes independent of each other at different spin velocities. In this manner, the push effort for the sweeper is reduced. The dual gear-wheel brush drive provides positive brush rotation which is superior to friction designs. Further, with the invention, the brush rolls are positioned much closer to the front edge of housing than conventional designs, thereby improving cleaning ability. Furthermore, the compact footprint of the foot assembly reduces storage requirements and enhances maneuverability. The rear mounted dirt cup is easy to access for removal and emptying with one hand. In addition, the horizontal split wall structure of the dirt cup improves dust/debris collection on forward and rearward strokes. The clear windows on the front of the housing give clear feed back to the operator about the operation of the brushes and the dirt pickup.

While the invention has been specifically described in connection with certain specific embodiments thereof, it is to be understood that this is by way of illustration and not of limitation. For example, although the invention has been described with respect to brushes that are preferably formed with paddles, other agitators such as bristle brushes can also be used according to the invention. Reasonable variation and modification are possible within the foregoing disclose and drawings without departing from the spirit of the invention which is embodied in the appended claims.

What is claimed is:

1. A floor sweeper for recovering material from a surface to be cleaned comprises:

a foot assembly adapted to move forward and backward across a surface to be cleaned and including a housing forming a brush chamber having a bottom opening;

a pair of driving wheels mounted to the housing for supporting the housing above the surface to be cleaned, each driving wheel including a driving gear;

a split brush assembly rotatably mounted within the brush chamber and adapted to contact the surface through the bottom opening, the split brush assembly including two independently mounted brushes mounted to the brush chamber mounted for rotation within the brush chamber independent of each other, each of the brushes having a brush gear that is in registry with one of the driving gears;

a single dirt receptacle mounted to the housing laterally to the brush chamber and in registry with the split brush assembly to receive dirt and debris from the brushes as the foot assembly moves forward or backward across the surface to be cleaned;

an upper dirt passage between the brushes and the dirt receptacle; and a lower dirt passage between the brushes and the dirt receptacle, wherein the lower dirt passage is positioned below the upper dirt passage and separated from the upper dirt passage by a first guide that is out of contact with the split brush assembly;

whereby each driving wheel drives one of the two brushes independently of the other brush so that the brushes can be rotated at different speeds as the foot assembly moves along the surface to be cleaned.

2. The floor sweeper of claim 1 wherein the split brush assembly is positioned at a forward portion of the foot assembly and the dirt receptacle is positioned at a rearward portion of the foot assembly.

3. The floor sweeper of claim 1 wherein each of the brushes includes paddles that are adapted to contact the surface to be cleaned during rotation and pick up dirt and debris.

4. The floor sweeper of claim 1 wherein the dirt receptacle is transparent.

5. The floor sweeper of claim 1 wherein the dirt receptacle comprises two dirt cavities, each of which is in communication with one of the two independently mounted brushes.

6. The floor sweeper of claim 5 wherein each of the two dirt cavities has a slot that is configured to receive a portion of one of the driving wheels.

7. The floor sweeper of claim 5 wherein the upper and lower passages respectively comprise an upper passage between each of the brushes and the corresponding dirt cavity and a lower passage between each of the brushes and the corresponding dirt cavity.

8. The floor sweeper of claim 1 wherein the brush chamber is configured to guide dirt and debris from the surface to be cleaned to the upper dirt passage or the lower dirt passage dependent on the rotational direction of the brushes.

9. The floor sweeper of claim 1 wherein the dirt receptacle has a pair of slots, each of which is configured to receive a portion of one of the driving wheels.

10. The floor sweeper of claim 1 wherein each driving wheel comprises gear teeth on each side of the outer periphery thereof, and the corresponding brush gear drivingly engages the gear teeth.

11. The floor sweeper of claim 10 wherein each of the brush gears is spaced inwardly of an outer end of the brush.

12. The floor sweeper of claim 11 wherein portions of the brush extend between each brush gear and the corresponding outer end of the brush.

13. The floor sweeper of claim 1 and further comprising a handle that is pivotally mounted to the foot assembly.

14. The floor sweeper of claim 1 wherein the foot assembly further comprises rollers on the forward and rear portions thereof for supporting the foot assembly on a surface to be cleaned, and wherein the forward rollers are longitudinally aligned with the brush gears.

15. The floor sweeper of claim 1 wherein the upper and lower passages respectively comprise an upper passage between each of the brushes and the dirt receptacle and a lower passage between each of the brushes and the dirt receptacle.

16. The floor sweeper of claim 1 wherein the lower passage further comprises a second guide for guiding dirt and debris from the brushes to the dirt receptacle.

17. The floor sweeper of claim 16 wherein the second guide is provided below the first guide.

18. The floor sweeper of claim 1 wherein the dirt receptacle comprises multiple dirt cavities.

* * * * *